US008187397B2

(12) United States Patent
Perez Cordova et al.

(10) Patent No.: US 8,187,397 B2
(45) Date of Patent: May 29, 2012

(54) LOW DENSITY EXPLOSIVE EMULSION

(75) Inventors: Pio Francisco Perez Cordova, Lima (PE); Luis Alfredo Cardenas Lopez, Lima (PE)

(73) Assignee: Industrias Minco, S.A.C. (PE)

( * ) Notice: Subject to any disclaimer, the term of this patent is extended or adjusted under 35 U.S.C. 154(b) by 0 days.

(21) Appl. No.: 12/944,986

(22) Filed: Nov. 12, 2010

(65) Prior Publication Data

US 2011/0120603 A1 May 26, 2011

(51) Int. Cl.

| | |
|---|---|
| ***C06B 47/00*** | (2006.01) |
| ***C06B 31/00*** | (2006.01) |
| ***C06B 31/28*** | (2006.01) |
| ***C06B 31/02*** | (2006.01) |
| ***D03D 23/00*** | (2006.01) |
| ***D03D 43/00*** | (2006.01) |

(52) U.S. Cl. ..... 149/46; 149/1; 149/45; 149/61; 149/108.2; 149/109.2; 149/109.4

(58) Field of Classification Search ..... 149/1, 45, 149/46, 61, 108.2, 109.2, 109.4
See application file for complete search history.

(56) References Cited

U.S. PATENT DOCUMENTS 4,141,766 A * 2/1979 Cameron et al. ..... 149/2
4,384,903 A * 5/1983 Enever ..... 149/7
4,409,044 A * 10/1983 Bhattacharyya et al. ..... 149/2
4,676,849 A * 6/1987 Curtin et al. ..... 149/2
4,756,776 A * 7/1988 Halliday et al. ..... 149/2
2006/0162237 A1 * 7/2006 Mullay et al. ..... 44/301

* cited by examiner

*Primary Examiner* — James McDonough
(74) *Attorney, Agent, or Firm* — Sanchelima & Associates, P.A.

(57) ABSTRACT

An explosive emulsion to be used in conjunction with a gas-producing agent, such as sodium nitrite, to form an explosive emulsion with a density between 0.50 g/cm$^3$ and 0.90 g/cm$^3$. The present invention also includes the method for producing the explosive emulsion. The explosive emulsion is stable for at least 96 hours with nitrogen bubbles, having a predetermined dimension range, homogenously distributed. To maintain this low-density explosive emulsion stable, between 84% and 95% by weight of an oxidizing solution is combined with 5% to 16% by weight of a fuel solution. The fuel solution includes solid cacao fat as a stabilizing agent and stearic acid to prevent the combination of the nitrogen bubbles. The method for producing the oxidizing solution includes combining ammonium nitrate, sodium nitrate, thiourea, urea, and water at a temperature between 80 and 90 degrees centigrade. In another step of the method, a fuel solution is produced by combining an emulsifier, oil, diesel No. 2 fuel, solid cacao fat, and stearic acid at a temperature between 40 and 60 degrees centigrade. Then between 84% and 95% of the oxidizing solution is combined with 5% to 16% of the fuel solution.

2 Claims, No Drawings

LOW DENSITY EXPLOSIVE EMULSION

BACKGROUND OF THE INVENTION

1. Field of the Invention

The present invention relates to a low density explosive emulsion that is selectively activated with a gas-producing agent, and more particularly, to such an emulsion that includes an oxidizing solution and a fuel solution.

2. Description of the Related Art

An explosive emulsion to be used in mining application where traditionally ANFO (ammonium-nitrate fuel oil) has been used. The emulsion in the present invention has characteristics that overcome the problems of generating large bubbles (or voids or hot spots) during the initial reaction of the gas solution with the emulsion.

SUMMARY OF THE INVENTION

It is one of the main objects of the present invention to provide a low density emulsion with high detonation speed than ANFO.

It is another object of this invention to provide such an emulsion that has a relatively high pressure of detonation.

It is still another object of the present invention to provide such an emulsion that is more resistant to water than ANFO.

Further objects of the invention will be brought out in the following part of the specification, wherein detailed description is for the purpose of fully disclosing the invention without placing limitations thereon.

DETAILED DESCRIPTION OF THE EMBODIMENTS FOR THE INVENTION

The present invention is a stable emulsion that can be selectively used with a gas-producing agent to sensitize it. The explosive emulsion consists essentially of an oxidizing solution and a fuel solution. The explosive emulsion has physical and chemical characteristics with adequate pH and rheology characteristics that make it suitable for on-site utilization and is completely inert without the gas-producing agent.

The oxidizing solution includes water as a continuous phase with oxidizing salts, such as ammonium nitrate ($NH_4NO_3$) or sodium nitrate ($NaNO_3$). Sodium nitrate reduces the crystallization point of the oxidizing solution.

Additionally, thiourea ($CH_4N_2S$) is added as a catalytic agent for the production of nitrogen bubbles (when activated by the addition of sodium nitrite, $NaNO_2$). A retarding agent, urea $(NH_2)_2CO$, is used to prevent a violent generation of nitrogen bubbles.

The fuel solution includes hydrocarbon compounds and at least one tensioactive (emulsifier) agent. The tensoactive agent, or agents, can be ionic or polymeric. Examples of these tensioactive agents are sorbitan monooleate, dehydrated xylitol monooleate, and polisobuten anhryde succinico. The use of cocoa butter provides consistency to the fuel solution, enhancing its ability to retain nitrogen bubbles. Stearic acid prevents the combination of small nitrogen bubbles to form larger bubbles that tend to more readily escape the fuel solution. The stearic acid provides the fuel solution a gel-like state when at rest, thereby increasing its viscosity and thus retaining the nitrogen bubbles.

It has been found that to produce an explosive emulsion that can be activated with a gas-producing agent, the gas-producing agent can be a nitrogen bubble-producing agent. The explosive emulsion consists of an oxidizing solution and a fuel solution. By weight, the oxidizing solution ranges from 84% to 95% and the fuel solution ranges from 5% to 16%.

The oxidizing solution, in one of the embodiments, has the following:

A) from 60% to 80% by weight of ammonium nitrate;
B) from 2% to 16% by weight of sodium nitrate;
C) from 0.1% to 2% by weight of thiourea;
D) from 14% to 22% by weight of water; and
E) from 2% to 12% by weight of urea.

The fuel solution in one of the embodiments has the following:

F) from 10% to 30% by weight of an emulsifier;
G) from 10% to 40% by weight of oil;
H) from 10% to 70% by weight of diesel No. 2 fuel;
I) from 0.1% to 10% by weight of solid cacao fat; and
J) from 0.1% to 30% by weight of stearic acid, thereby preventing the combination of resulting nitrogen bubbles to firm larger nitrogen bubbles.

The present invention covers also the method for producing an explosive low density emulsion that is selectively activated with a gas-producing agent. The method includes the steps of:

A) dissolving oxidizing salts in water at a temperature between 80 degrees and 90 degrees centigrade, resulting in an oxidizing solution that consists essentially of:
   i) from 60% to 80% by weight of ammonium nitrate;
   ii) from 2% to 16% by weight of sodium nitrate;
   iii) from 0.1% to 2% by weight of thiourea;
   iv) from 14% to 22% by weight of water; and
   v) from 2% to 12% by weight of urea;
B) preparation of a continuous phase at a temperature between 40 degrees and 60 degrees centigrade, resulting in a fuel solution that consists essentially of:
   i) from 10% to 30% by weight of an emulsifier;
   ii) from 10% to 40% by weight of oil;
   iii) from 10% to 70% by weight of diesel No. 2 fuel;
   iv) from 0.1% to 10% by weight of solid cacao fat; and
   v) from 0.1% to 30% by weight of stearic acid, thereby preventing the combination of resulting nitrogen bubbles to firm larger nitrogen bubbles;
C) mixing from 84% to 95% by weight of said oxidizing solution with 5% to 16% by weight of said fuel composition at a rotational speed between 600 and 2000 rpm to form a non-explosive solution with particles the size of less than 5 microns and having a density between 1.30 $g/cm^3$ and 1.40 $g/cm^3$ and a pH between 5.0 and 7.0.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A non-explosive emulsion having a density between 1.30 $g/cm^3$ and 1.40 $g/cm^3$ to be selectively activated by a gas-producing agent resulting in an explosive emulsion having a density between 0.50 $g/cm^3$ and 0.90 $g/cm^3$, and said non-explosive emulsion consisting essentially of between 84% and 95% by weight of an oxidizing solution and between 5% and 16% by weight of a fuel solution, said oxidizing solution consisting essentially of:

A) from 60% to 80% by weight of ammonium nitrate;
B) from 2% to 16% by weight of sodium nitrate;
C) from 0.1% to 2% by weight of thiourea;
D) from 14% to 22% by weight of water; and
E) from 2% to 12% by weight of urea, and said fuel solution consisting essentially of:

F) from 10% to 30% by weight of an emulsifier;

G) from 10% to 40% by weight of oil;

H) from 10% to 70% by weight of diesel No. 2 fuel;

I) from 0.1% to 10% by weight of solid cacao fat; and

J) from 0.1% to 30% by weight of stearic acid.

2. The emulsion set forth in claim 1 wherein said explosive emulsion is activated with an agent that produces nitrogen bubbles.

* * * * *